US005415371A

United States Patent [19]

Kirchner

[11] Patent Number: 5,415,371

[45] Date of Patent: May 16, 1995

[54] MARTIAL-ARTS BREAKING-BOARD HOLDER

[76] Inventor: Daniel J. Kirchner, 10215 E. Placita Cresta Verde, Tucson, Ariz. 85749

[21] Appl. No.: 176,225

[22] Filed: Jan. 3, 1994

[51] Int. Cl.[6] ..... A47G 1/10

[52] U.S. Cl. ..... 248/316.4; 211/41; 248/309.1; 482/83

[58] Field of Search ..... 248/316.4, 201, 274, 248/309.1, 125; 482/83, 84, 908; 211/41, 89

[56] References Cited

U.S. PATENT DOCUMENTS

| | | | |
|---|---|---|---|
| 278,116 | 5/1883 | Fisher | 248/231.4 X |
| 293,783 | 2/1884 | Ransom | 211/23 |
| 420,761 | 2/1890 | Bettendorf | 211/24 |
| 846,676 | 3/1907 | Linklater | 211/89 |
| 1,209,560 | 12/1916 | Cosner | 248/316.4 X |
| 1,266,333 | 5/1918 | Sholley | 211/89 |
| 2,831,339 | 4/1958 | Jones | 248/201 X |
| 4,233,769 | 11/1980 | Archer | 40/607 |
| 4,757,989 | 7/1988 | Bauer, Jr. | 482/83 |
| 4,889,334 | 12/1989 | Partlo | 482/83 |
| 5,181,335 | 1/1993 | Todd | 248/125 X |

OTHER PUBLICATIONS

AWMA 1993 Catalog, p. 51, Item #8498, (copy enclosed).

Uniform Catalog, p. 12, Item #BBD-1, (copy enclosed).

*Primary Examiner*—Alvin C. Chin-Shue

*Assistant Examiner*—Korie H. Chan

*Attorney, Agent, or Firm*—Antonio R. Durando; Harry M. Weiss

[57] ABSTRACT

A breaking-board holder that consists of two parallel support arms slidably and rotatably mounted on a bar that is firmly anchored to a solid structure, such as a wall or a floor. Each support arm comprises a transverse groove adapted to receive and hold the edge of a conventional martial-arts breaking board, so that the two arms together can be used to hold a board firmly in place. Because the arms are slidably mounted on the bar, the distance between them can be adjusted to accommodate boards of different sizes and users of different heights. Similarly, because the arms are rotatably disposed on the bar, the position of the board can be adjusted to face the direction needed for a given exercise. In order to facilitate the release of the board after breakage, the inner sides of the grooves in the support arms are beveled, which permits the inward folding of the board parts as they are taken apart by the blows exerted on them.

19 Claims, 1 Drawing Sheet

MARTIAL-ARTS BREAKING-BOARD HOLDER

BACKGROUND OF THE INVENTION

1. Field of the Invention

This invention is related in general to the field of martial-arts equipment and, in particular, to an adjustable breaking-board holder for use by practitioners during training for rank testing.

2. Description of the Prior Art

The practice of martial arts involves breaking wooden boards of specific dimensions and thickness by striking them while they are being held in a stationary position. This skill is required for ranking and it is tested by having one or more people hold a board while it is being struck by a practitioner, the intent being to break the board with a single blow. Therefore, it is impossible for an individual to practice kicks and hand or elbow blows while alone, which is a severe drawback in preparing for tests that are required to achieve higher rankings in the martial arts.

Devices have been developed to facilitate the process of holding a board during practice. For example, a board holder with hand grips is marketed by Asian World Of Martial Arts, Inc., of Philadelphia, Pa., to provide some safety distance between a holder and the impact zone. The device consists of two separate handgrips that are adapted for attachment to the edges of the board, so that it is no longer necessary to hold the board directly in order to resist the impact of a blow. This device is useful to minimize the possibility of injuries to a holder, but it still requires an additional person to hold the board.

Another device, marketed by the Academy Of Karate Martial Arts Supplies of Haddon Heights, N.J., consists of a stand for supporting a wood board horizontally against the impact of the blows of a practitioner. The stand eliminates the need for another person, but it can be used only for practicing downward strikes against a perfectly level board; otherwise, it is unstable and it could be dangerous to a user. Therefore, there still exists a need for a safe, self-contained breaking-board holder that enables a user to practice martial-arts blows without the assistance of another person.

BRIEF SUMMARY OF THE INVENTION

One objective of this invention is a self-contained breaking-board holder that can be used to practice martial-arts blows resulting from hand, elbow and foot strikes taken from multiple directions.

Another goal of the invention is a holder that is firmly anchored to a stationary structure to provide the necessary resistance to a blow to cause the breaking of the board held within it upon impact.

Yet another goal is a board holder that can be adjusted vertically to conform to the requirements of different exercises and different-height users.

Another objective of the invention is a holder that is also adjustable in width, so that it can be used interchangeably with boards of different dimensions.

A further objective is a holder that can be used with up to three boards at the same time.

A final objective is the easy and economical manufacture of the invention according to the above stated criteria. This is achieved by using commercially available materials and manufacturing processes, modified only to the extent necessary to fit the requirements of the invention.

Therefore, according to these and other objectives, the present invention consists of two parallel support arms slidably and rotatably mounted on a bar that is firmly anchored to a solid structure, such as a wall or a floor. Each support arm comprises a transverse groove adapted to receive and hold the edge of a conventional martial-arts breaking board, so that the two arms together can be used to hold a board firmly in place. Because the arms are slidably mounted on the bar, the distance between them can be adjusted to accommodate boards of different sizes. Similarly, because the arms are rotatably disposed on the bar, the position of the board can be adjusted to face the direction needed for a given exercise. In order to facilitate the release of the board after breakage, the inner sides of the grooves in the support arms are at least partially beveled, which permits the inward folding of the board parts as they are taken apart by the blows exerted on them.

Various other purposes and advantages of the invention will become clear from its description in the specification that follows and from the novel features particularly pointed out in the appended claims. Therefore, to the accomplishment of the objectives described above, this invention consists of the features hereinafter illustrated in the drawings, fully described in the detailed description of the preferred embodiment and particularly pointed out in the claims. However, such drawings and description disclose but one of the various ways in which the invention may be practiced.

DETAILED DESCRIPTION OF THE INVENTION

Figure 1:
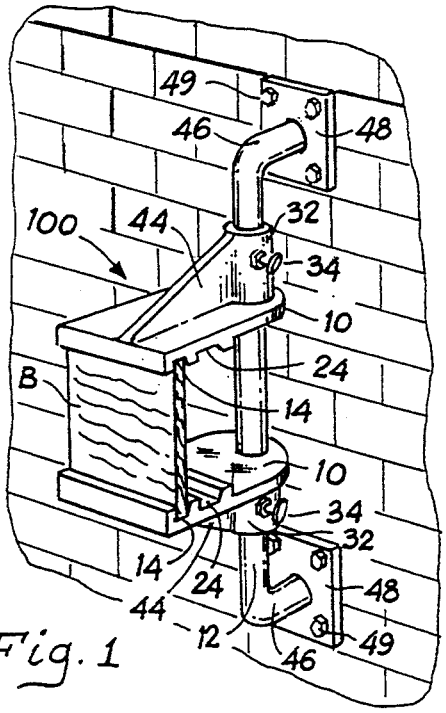
FIG. 1 is a perspective view of a breaking-board holder according to the present invention.

This invention lies in a combination of structural members that provides apparatus with adjustable features for holding a martial-arts breaking board firmly and safely, so that a user can practice different kinds of blows without the assistance of another person. Referring to the drawings, wherein like parts are designated throughout with like numerals and symbols, FIG. 1 illustrates in perspective view the preferred embodiment of a breaking-board holder 100 according to the invention. The holder 100 is illustrated as mounted vertically on a wall W capable of resisting the impact of martial-arts blows exerted by a user without collapsing or damaging the structure of which it is part. It is understood, though, that the holder could be equivalently mounted on any firm structure and in any position appropriate for its intended use.

The holder 100 consists of two symmetrical support arms 10 (shown in the drawings as plates) slidably mounted on a bar 12 and adapted to receive and hold in place therebetween a conventional martial-arts breaking board B. The arms 10 are preferably disposed in parallel to each other at right angle with the bar and each arm comprises at least one transverse groove, such as 14, facing the other arm for holding an edge of the board B inserted therethrough. As better illustrated in the enlarged partial view of FIG. 2, each groove is preferably formed by two parallel lips that protrude in the direction of the opposite support arm and that are spaced apart by a distance approximately equal to the thickness of a conventional breaking board (approximately 2.2 cm, or $\frac{7}{8}$ of an inch), or a multiple thereof. Each groove consists of an outer lip with a square side facing the groove (and the board, when in place) and an inner lip with an at least partially beveled side facing the board (the terms outer and inner are used with respect to the direction of collapse of the board upon impact, as will become clear from the description below).

Figure 2:
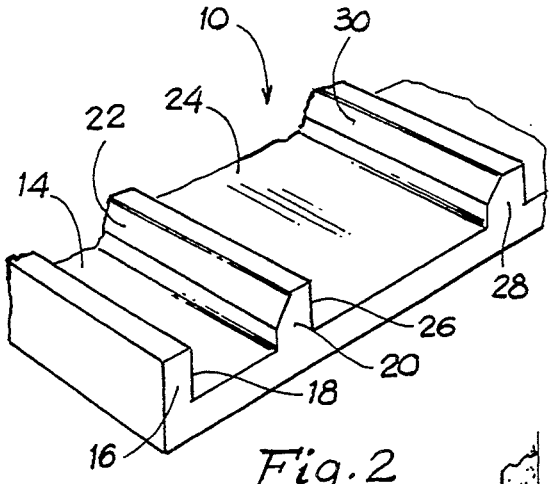
FIG. 2 is an enlarged partial view of a support arm illustrating the grooves used for holding a breaking board and the beveled configuration of the inner lip of each groove.

For example, as seen in FIG. 2, groove 14 is formed by the outer lip 16, that has a square side 18 facing the groove, and by the inner lip 20, that has a beveled side 22 facing the groove. The lower portion of the beveled side 22 is preferably square to provide a snug fit with the edge of the board B, while the upper portion of side 22 is beveled, as illustrated in FIG. 2. In the preferred embodiment of the invention the square and beveled portions are about 1 and 3 fourths on an inch tall, respectively, but any proportion of beveled configuration that would facilitate the release of the board during breakage is acceptable.

FIG. 2 also illustrates a groove 24 having twice the width of groove 14 so that two breaking boards may be accommodated at the same time. With respect to groove 24, lip 20 constitutes the outer lip with a square side 26 toward the groove and the inner lip 28 provides a beveled side 30 toward the groove. As will become more apparent from the description of the mode of operation of the invention, the beveling of the inner lip facing each groove facilitates the release of the board B after breakage, helping prevent injuries that might otherwise occur to a user if the parts of a broken board were retained firmly entrenched in the grooves during impact. Accordingly, even though this beveled-lip feature is not essential to the general concept of the breaking-board holder of the invention, it is considered a valuable improvement thereto and is highly preferred and recommended. Note that the lips could be formed in equivalent fashion by cutting a groove in solid plate material, rather than by forming protruding ridges as shown in the drawings.

Each support arm 10 is mounted on the bar 12 by means of a mechanism that allows it to rotate about the axis of the bar and also to slide longitudinally along the bar. In the preferred embodiment of the invention, this is achieved by having a bar 12 with a circular cross-section, either in the form of a pipe or a solid rod, and by having each arm 10 rigidly attached to a circular sleeve or collar 32 having an inner diameter slightly larger than the outer diameter of the bar 12, so that the two can be snugly coupled in slidable and rotatable engagement. Thus, the distance between the arms 10 can be adjusted by sliding the collars 32 along the length of the bar 12 to account for breaking boards of different sizes. This feature also allows adjustments of the elevation of the holder to conform to the requirements of different exercises and the height of different users. Moreover, the collars can be rotated around the bar axis to align the grooves 14 and 24 of each support arm in parallel to each other in any direction on a plane perpendicular to the bar, so that the device may be used to receive blows from multiple directions. A reinforcing brace 44 may be attached to each collar/arm combination to provide additional rigidity and stability to the assembly.

Figure 3:
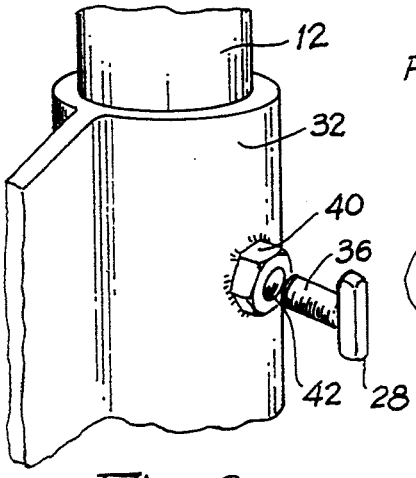
FIG. 3 is an enlarged partial view of the threaded bolt/nut mechanism utilized to lock the movable collars in place along the rigid bar of the invention.

Locking means 34 are provided to hold each collar in place after position adjustments. As illustrated in the enlarged partial view of FIG. 3, such means may comprise, for example, a threaded bolt 36 equipped with a winged head 38 and a matingly-threaded perforation in the collar 42, such that the bolt may be screwed into the collar and tightened to apply locking pressure to the outer surface of the bar 12, thereby preventing the relative movement of the collar and the bar. A threaded nut 40, fixedly attached (such as by welding) to each collar 32 over the perforation 42, may be used instead of or in addition to the threads in the perforation 42. The winged head 38 of the bolt 36 provides the necessary leverage for tightening the bolt by hand.

Note that different means obvious to those skilled in the art could be used to couple the bar 12 and arms 10 in slidable and rotatable fashion. For instance, a sleeve and bar with the same non-circular cross-sections (such as square) could be slidably engaged in equivalent fashion, and each arm could be coupled to the sleeve through adjustable pivotable means. Any such embodiment would be more complex and expensive than the one described herein; therefore, the latter is preferred.

The bar 12 must be rigidly mounted on a base anchored to a solid supporting structure W, so that the holder assembly constitutes a rigid body capable of withstanding the impact of blows exerted on the board B held between the support arms 10. In the preferred embodiment, each end 46 of the bar 12 is curved and rigidly attached to a plate 48 that is anchored to a wall or floor by means of bolts 49 or other equivalent fastening apparatus. The length of the bar ends 46 past the point of curvature must provide enough clearance between the bar 12 and the supporting structure W to allow the free rotation of the arms 10 around the bar over a radial range of approximately 180 degrees, so that adjustments may be made to the position of the board B in relation to the intended direction of the planned strikes, as desired. The bar 12 needs to be sufficiently long to provide room for vertical adjustments of the assembly (and for accommodating different-size boards), but not so long that it flexes significantly and reduces the assembly's structural strength.

Thus, inasmuch as standard breaking boards are substantially rectangular, about 30.5 cm (12 inches) long and 30.5 cm (12 inches) wide for adults and about 30.5 cm (12 inches) long and 20.3 cm (8 inches) wide for children, a bar approximately 1.5 meters (5 feet) long is recommended. Similarly, support arms having grooves about 30.5 cm (12 inches) long are preferred.

Figure 4:
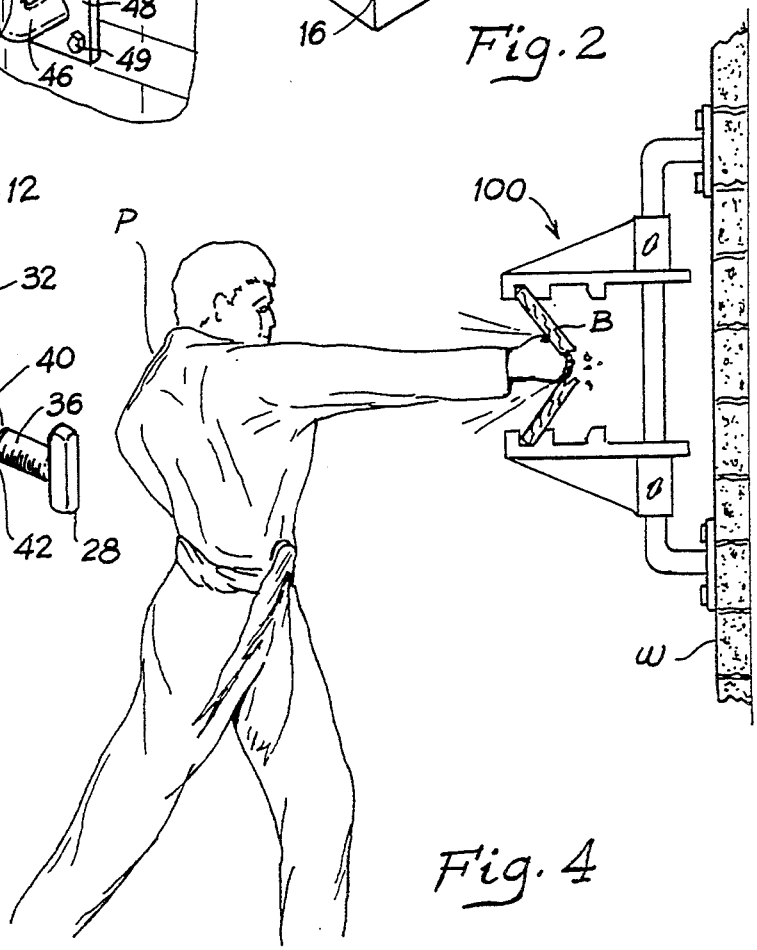
FIG. 4 shows in side view a martial-arts practitioner striking and breaking a board supported by the breaking-board holder of the invention.

In order to set up the assembly of the invention for use (after it has been mounted, for example, on a wall), one of the support arms 10 is placed at the desired location by releasing it from the bar 12, sliding it and rotating it to the appropriate position along the bar, and locking it in place by the locking means 34. Then the other arm is also released and a breaking board B is clamped within the grooves 14 of both arms with the wood grain disposed substantially in parallel to the arm grooves. Finally the second arm is locked in place, whereby the board remains firmly sandwiched between the two arms 10 in the chosen position. The board B is thus set up for striking by a user in the same manner as if the board were being held by another person. An illustration of the assembly of the invention in use is given in FIG. 4, wherein a martial-arts practitioner P is shown delivering a fist blow to a board B and breaking it. As desired, the board breaks along the wood grain and its two parts are released and allowed to fold forward by the beveled sides 22 of the inner lips 20. Note that two boards could be used at the same time by inserting them together in the grooves 24 of the apparatus, which are twice as wide as groove 14. Three boards could similarly be employed by using both sets of grooves. More grooves could be added to the device, but are not required because even the most expert practitioners use at most three boards at a time.

The breaking-board holder of the invention can be made from a variety of commercially available materials such as plastic, metal and wood. Although the material chosen must be compatible with the general function of a breaking-board holder (it must be rigid and capable of withstanding the impact of blows delivered during use), the choice of material will not affect the particular holding function of the invention. In addition, the invention can obviously take other shapes than described with equivalent functionality and utility. In fact, any shape for any of the components that is not specifically described is acceptable to practice the invention so long as it retains the functional characteristics described above.

Thus, various changes in the details, steps and materials that have been described may be made by those skilled in the art within the principles and scope of the invention herein illustrated and defined in the appended claims. Therefore, while the present invention has been shown and described herein in what is believed to be the most practical and preferred embodiments, it is recognized that departures can be made therefrom within the scope of the invention, which is not to be limited to the details disclosed herein but is to be accorded the full scope of the claims so as to embrace any and all equivalent apparatus and methods.

I claim:

1. A device for holding a martial-arts breaking board in a firm position for striking by a user whereby the board may be broken on impact and released, comprising:

a rigid bar having two ends;

anchoring means connected to each end of said rigid bar for rigidly mounting the bar on a supporting structure;

a pair of support arms, each arm having a main axis extending radially from said rigid bar and comprising at least one groove adapted to receive and hold an edge of said breaking board, said groove being disposed substantially perpendicularly to said main axis of the arm and being disposed at a sufficient distance from said rigid bar to permit the release of said breaking board upon breakage;

mounting means for slidably and rotatably connecting each of said support arms to said rigid bar, the support arms being disposed such that said grooves in each support arm face each other; and releasable locking means for securing each support arm in place after slidable and rotatable adjustment along and around said rigid bar.

2. The device recited in claim 1, wherein said rigid bar consists of a pipe having curved ends.

3. The device recited in claim 2, wherein said anchoring means consists of a plate attached to each of said curved ends of the pipe and adapted for fastening to a supporting structure.

4. The device recited in claim 1, wherein each of said pair of support arms consists of a plate disposed at right angle with said rigid bar.

5. The device recited in claim 1, wherein each of said at least one groove in each support arm is formed by two parallel lips that protrude in the direction of the other support arm.

6. The device recited in claim 5, wherein said two parallel lips forming each of said at least one groove are spaced apart by a distance of approximately 2.2 cm or multiples thereof.

7. The device recited in claim 1, wherein said rigid bar has a circular cross-section and said mounting means for slidably and rotatably connecting each of said support arms to said rigid bar consists of a pair of circular collars having an inner diameter slightly larger than the bar, so that each collar can be snugly coupled to the bar in slidable and rotatable engagement, each collar being rigidly attached to one of said pair of support arms.

8. The device recited in claim 7, further comprising a reinforcing brace connecting each collar and the support arm to which the collar is rigidly attached.

9. The device recited in claim 7, wherein said releasable locking means consists of a threaded bolt and a matingly-threaded perforation in each of said collars, such that the bolt may be screwed into the collar and tightened to apply locking pressure to said rigid bar, thereby preventing movement of said collar with respect to said bar.

10. The device recited in claim 9, further comprising a threaded nut fixedly attached to each of said collars for engagement with said threaded bolt.

11. The device recited in claim 10, wherein said threaded bolt comprises a winged head.

12. The device recited in claim 1, wherein said releasable locking means consists of a threaded bolt and a matingly-threaded perforation in said mounting means, such that the bolt may be screwed into the mounting means and tightened to apply locking pressure to said rigid bar, thereby preventing movement of said mounting means with respect to said bar.

13. The device recited in claim 12, further comprising a threaded nut fixedly attached to said mounting means for engagement with said threaded bolt.

14. The device recited in claim 12, wherein said threaded bolt comprises a winged head.

15. A device for holding a martial-arts breaking board in a firm position for striking by a user whereby the board may be broken on impact and released, a rigid bar;

anchoring means connected to said rigid bar for rigidly mounting the bar on a supporting structure;

a pair of support arms, each arm comprising at least one groove adapted to receive and hold an edge of said breaking board;

mounting means for slidably and rotatably connecting each of said support arms to said rigid bar, the support arms being disposed such that said grooves in each support arm face each other; and releasable locking means for securing each support arm in place after slidable and rotatable adjustment along and around said rigid bar;

wherein each of said at least one groove is formed by an outer lip having a square side facing the groove and by a parallel inner lip having a beveled side facing the groove.

16. The device recited in claim 15, wherein said outer lip and said parallel inner lip forming each of said at least one groove are spaced apart by a distance of approximately 2.2 cm or multiples thereof.

17. The device recited in claim 16, wherein said rigid bar consists of a pipe having curved ends;

said anchoring means consists of a plate attached to each of said curved ends of the pipe and adapted for fastening to a supporting structure;

each of said pair of support arms consists of a plate disposed at right angle with to said pipe;

said pipe has a circular cross-section and said mounting means for slidably and rotatably connecting each of said support arms to said pipe consists of a pair of circular collars having an inner diameter slightly larger than the pipe, so that each collar can be snugly coupled to the pipe in slidable and rotatable engagement, each collar being rigidly attached to one of said pair of support arms; and said mounting means further comprising a reinforcing brace connecting each collar and the support arm to which the collar is rigidly attached; and said releasable locking means consists of a threaded bolt with a winged head and a matingly-threaded perforation in each of said collars, such that the bolt may be screwed into the collar and tightened to apply locking pressure to said pipe, thereby preventing movement of said collar with respect to said pipe.

18. The device recited in claim 17, wherein said grooves are approximately 30.5 cm long and said pipe is approximately 150 cm long.

19. A device for practicing martial arts, comprising:

a rigid bar having two ends;

anchoring means connected to each end of said rigid bar for rigidly mounting the bar on a supporting structure;

a pair of support arms, each arm having a main axis extending radially from said rigid bar and comprising at least one groove adapted to receive and hold an edge of a breaking board, said groove being disposed substantially perpendicularly to said main axis of the arm and being disposed at a sufficient distance from said rigid bar to permit the release of a breaking board mounted thereon upon breakage;

mounting means for slidably and rotatably connecting each of said support arms to said rigid bar, the support arms being disposed such that said grooves in each support arm face each other;

releasable locking means for securing each support arm in place after slidable and rotatable adjustment along and around said rigid bar; and a breaking board mounted within said grooves of the support arms.

* * * * *